US006699361B1

(12) United States Patent
Leandersson

(10) Patent No.: US 6,699,361 B1
(45) Date of Patent: Mar. 2, 2004

(54) PAPERMAKING DEVICE FOR PRODUCING A MULTILAYER LINER AND ASSOCIATED METHODS

(75) Inventor: Anders Leandersson, Karlstad (SE)

(73) Assignee: Metso Paper Karlstad AB, Karlstad (SE)

( * ) Notice: Subject to any disclaimer, the term of this patent is extended or adjusted under 35 U.S.C. 154(b) by 0 days.

(21) Appl. No.: 09/656,563

(22) Filed: Sep. 7, 2000

Related U.S. Application Data

(60) Provisional application No. 60/169,557, filed on Dec. 8, 1999.

(30) Foreign Application Priority Data

Sep. 7, 1999 (SE) ..... 9903166

(51) Int. Cl.[7] ..... D21F 11/00; D21F 7/00

(52) U.S. Cl. ..... 162/123; 162/205; 162/129; 162/358.1; 162/300; 162/304

(58) Field of Search ..... 162/123–133, 162/205, 210, 290–305, 358.1, 358.3, 358.4

(56) References Cited

U.S. PATENT DOCUMENTS

| | | | | | |
|---|---|---|---|---|---|
| 3,884,756 | A | * | 5/1975 | Gustafson | 162/299 |
| 3,905,864 | A | * | 9/1975 | Curry et al. | 162/133 |
| 4,197,158 | A | | 4/1980 | Johnson | |
| 4,584,058 | A | * | 4/1986 | Lehtinen et al. | 428/315.9 |
| 4,961,824 | A | | 10/1990 | Laitinen et al. | |
| 5,011,741 | A | * | 4/1991 | Hoffman | 428/534 |
| 5,074,964 | A | | 12/1991 | Partanen | |
| 5,178,732 | A | | 1/1993 | Steiner et al. | |
| 5,445,713 | A | * | 8/1995 | Kunihisa et al. | 162/304 |
| 5,681,431 | A | | 10/1997 | Steiner | |
| 5,783,045 | A | * | 7/1998 | Santos et al. | 162/301 |
| 5,792,320 | A | * | 8/1998 | Kaasalainen et al. | 162/205 |
| 5,908,536 | A | * | 6/1999 | Kaasalainen et al. | 162/205 |
| 6,432,273 | B1 | * | 8/2002 | Honkalampi et al. | 162/205 |

FOREIGN PATENT DOCUMENTS

| | | | | |
|---|---|---|---|---|
| EP | 0 233 058 | A2 | 8/1987 | |
| EP | 0 511 185 | A1 | 10/1992 | |
| EP | 0 511 186 | A1 | 10/1992 | |
| EP | 1 076 606 | B1 | 2/2001 | |
| WO | WO 92/06242 | A1 | 10/1990 | |
| WO | WO 97/45589 | A1 | 5/1996 | |
| WO | WO 200118309 | A1 * | 3/2001 | D21F/11/04 |

* cited by examiner

*Primary Examiner*—José A Fortuna
(74) *Attorney, Agent, or Firm*—Alston & Bird LLP

(57) ABSTRACT

A method for the production of a liner comprising at least a top layer and a base layer is provided, wherein a forming section with at least two forming units is used to create a fiber web, said fiber web being conveyed through a press section and further to a drying section, said press section comprising a number of roll nips and at least one impermeable transfer belt with at least one smooth surface, wherein said transfer belt runs through the last nip in the press section in such a manner that its top layer is pressed against said smooth surface of the transfer belt.

27 Claims, 6 Drawing Sheets

PAPERMAKING DEVICE FOR PRODUCING A MULTILAYER LINER AND ASSOCIATED METHODS

CROSS-REFERENCE TO RELATED APPLICATIONS

This application claims the benefit of U.S. Provisional Application No. 60/169,557, filed Dec. 8, 1999.

FIELD OF THE INVENTION

The present invention relates to a method for the production of a liner comprising in at least a top layer and a base layer, wherein a forming section with at least two forming units is used to create a fiber web, said fiber web being conveyed through a press section and further to a drying section, said press section comprising a number of roll nips and at least one impermeable transfer belt with at least one smooth surface. The invention also relates to a paper machine for realization of the method.

BACKGROUND OF THE INVENTION

A liner, a form of multilayer board, comprises frequently a top layer, which is intended for printing. This top layer must display a high smoothness in order to achieve good printability. For production of the surface layer, bleached pulp is preferably used, more particularly, pulp which is bleached to high brightness and which contains short fibers.

Different methods and machines for the production of multilayer board are described in a number of different documents in the patent literature, e.g., EP 1 076 606, U.S. Pat. No. 5,681,431, U.S. Pat. No. 5,178,732, EP 0 511 186, WO 92/06242, U.S. Pat. No. 4,961,824, EP 0 511 185, U.S. Pat. No. 5,074,964, EP 0 233 058 and SE 506 611. However, none of these documents teach how to produce multilayer board, i.e. a liner, wherein a layer intended for printing can acquire a very good printability in a high speed process.

SUMMARY OF THE INVENTION

The above and other needs are met by the present invention which, in one embodiment, provides a method for the production of a liner comprising at least a top layer and a base layer. A forming section is provided, having at least two forming units to create a fiber web. A press section is provided, comprising a number of rolls and a transfer belt with at least one smooth surface, wherein at least some of said rolls form roll nips comprising a last roll nip for conveying said fiber web through the press section and further to a drying section. By moving said transfer belt through the last nip in the press section, the fiber web is conveyed through the last nip of the press section in such a manner that the layer intended for printing of the web is pressed against said smooth surface of the transfer belt. In this manner, the layer intended for printing acquires a very good printability, wherein the fiber web is simultaneously transferred through the press section at a relatively higher speed.

In accordance with further aspects of the method:

- the fiber web is exposed to a liner load of between 600–2000 KN/m in said last nip,
- the fiber web W is conveyed through at least three nips in the press section and
- the fiber web W in the next-to-last nip is exposed to a linear load of between 30–150 KN/m,
- the fiber web W, before the next-to-last nip, is conveyed through a leading nip which consists of a shoe press and under a linear load of between 200–1000 kN/m,

- the fiber web W, before the next-to-last nip, is conveyed through a leading nip which consists of a press and under a linear load of between 50–200 kN/m,
- the base layer is formed of unbleached pulp which is substantially long-fibered and preferably contains fir and/or pine fibers and the top layer is formed of a pulp, which at least partially contains short fibers such as birch or eucalyptus fibers, wherein the pulp for the top layer is also preferably bleached.
- the grammage of the completed liner is 60–205 g/m$^2$, preferably 60–150 g/m$^2$.
- the fiber web W is conveyed through the press section P at a speed of 750–2000 m/min, preferably exceeding 1000 m/min, more preferably exceeding 1200 m/min,
- the layer intended for printing consists of bleached pulp,
- the layer intended for printing contains at least 30 weight-% of short fibers,
- the layer intended for printing contains at least 50 weight-% of short fibers.
- the layer intended for printing is formed on top of the base layer in the forming section, so that layer intended for printing of the fiber web constitutes the upper layer of the web W.

Embodiments of the invention also relate to a paper machine for production of a liner, comprising a forming section and a press section, said forming section comprising at least two forming units in order to permit production of a fiber web with at least two layers of which one layer constitutes a top layer, said press section comprising a plurality of rolls and a transfer belt with at least one smooth surface, wherein at least some of said rolls form roll nips comprising a last nip, wherein said last nip is through-fed by said transfer belt and arranged such that its smooth surface is directed against the layer intended for printing of the fiber web when the fiber web runs through said last nip.

In accordance with further aspects of the paper machine:

- the smooth surface of the transfer belt is directed away from an upper press roll in said last nip, said last nip preferably comprising a shoe press unit;
- the press section comprises at least three nips, wherein preferably the next-to-last nip consists of a press,
- said three nips are achieved with four roll units,
- said three nips are achieved with five roll units, wherein preferably the first of said three nips comprises a shoe press,
- said transfer belt is impermeable.

Further, the invention relates to a method for production of a liner comprising at least one layer of bleached pulp and one layer of unbleached pulp. A forming section is provided, having at least two forming units to create a fiber web. A press section is provided, comprising a number of rolls and one transfer belt with at least one smooth surface, wherein at least some of said rolls form roll nips comprising a last nip for conveying said fiber web through the press section and further to a drying section, wherein said transfer belt is moved through said last nip of the press section in such a manner that the layer of bleached pulp is pressed against said smooth surface of the transfer belt.

Finally, the invention relates to a method for production of a liner comprising at least one layer of pulp containing at least 30 weight-% of short fibers and one layer of pulp containing essentially long fibers. A forming section is provided, having at least two forming units for creating a fiber web. A press section is provided, comprising a number of rolls and one transfer belt with at least one smooth surface, wherein at least some of said rolls form roll nips comprising a last nip for conveying said fiber web through the press section and further to a drying section, wherein said transfer belt runs through the last nip in the press section and the fiber web is conveyed through the last nip in the press section in such manner that the layer consisting of at least 30 weight-% of short fiber pulp is pressed against said smooth surface of the transfer belt.

BRIEF DESCRIPTION OF THE DRAWINGS

Figure 1:
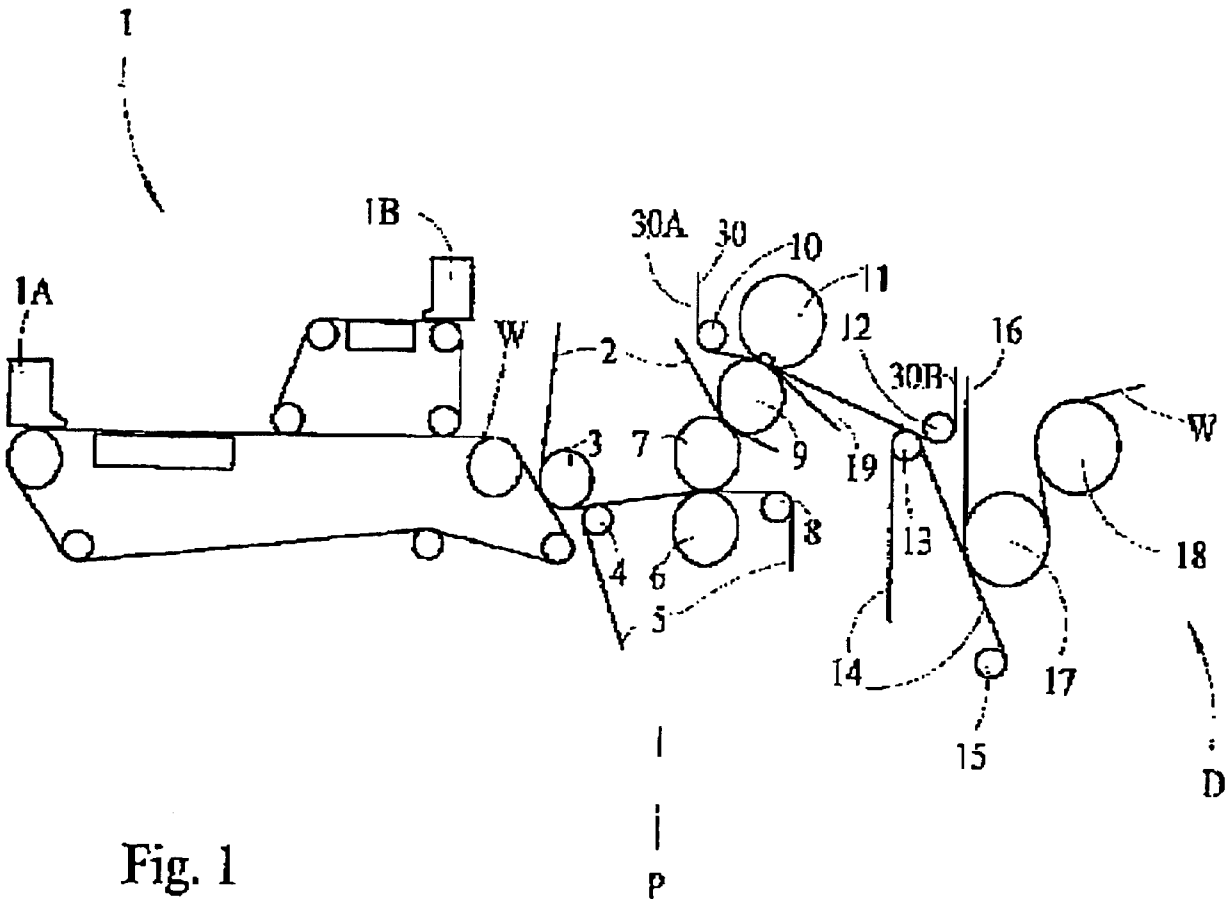

Having thus described the invention in general terms, reference will now be made to the accompanying drawings, which are not necessarily drawn to scale, and wherein:

FIG. 1 is a schematic representation of a forming section and a press section in accordance with one embodiment of the invention.

Figure 2:
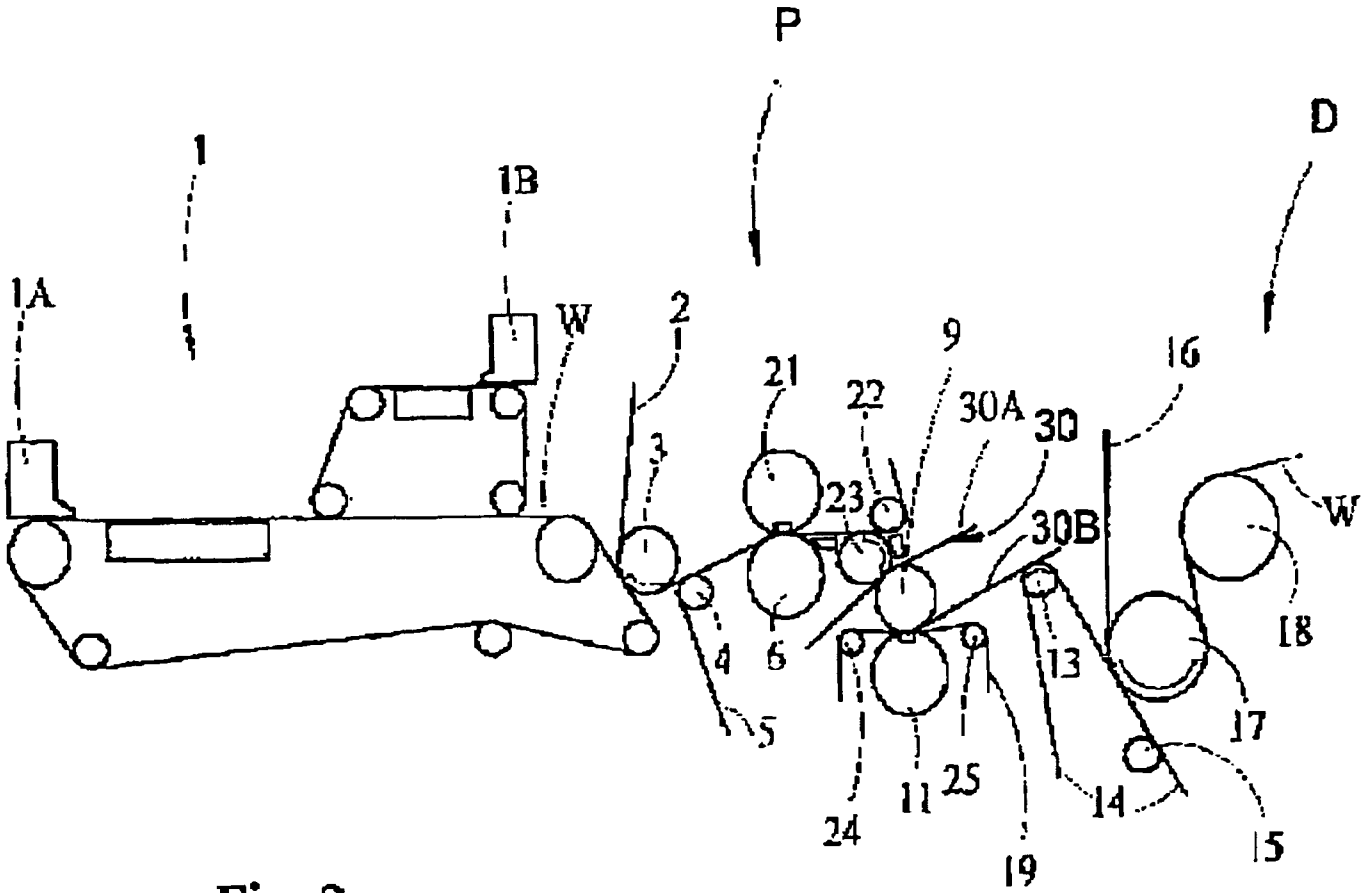

FIG. 2 is a schematic representation of a press section according to an alternate embodiment of the invention.

Figure 3:
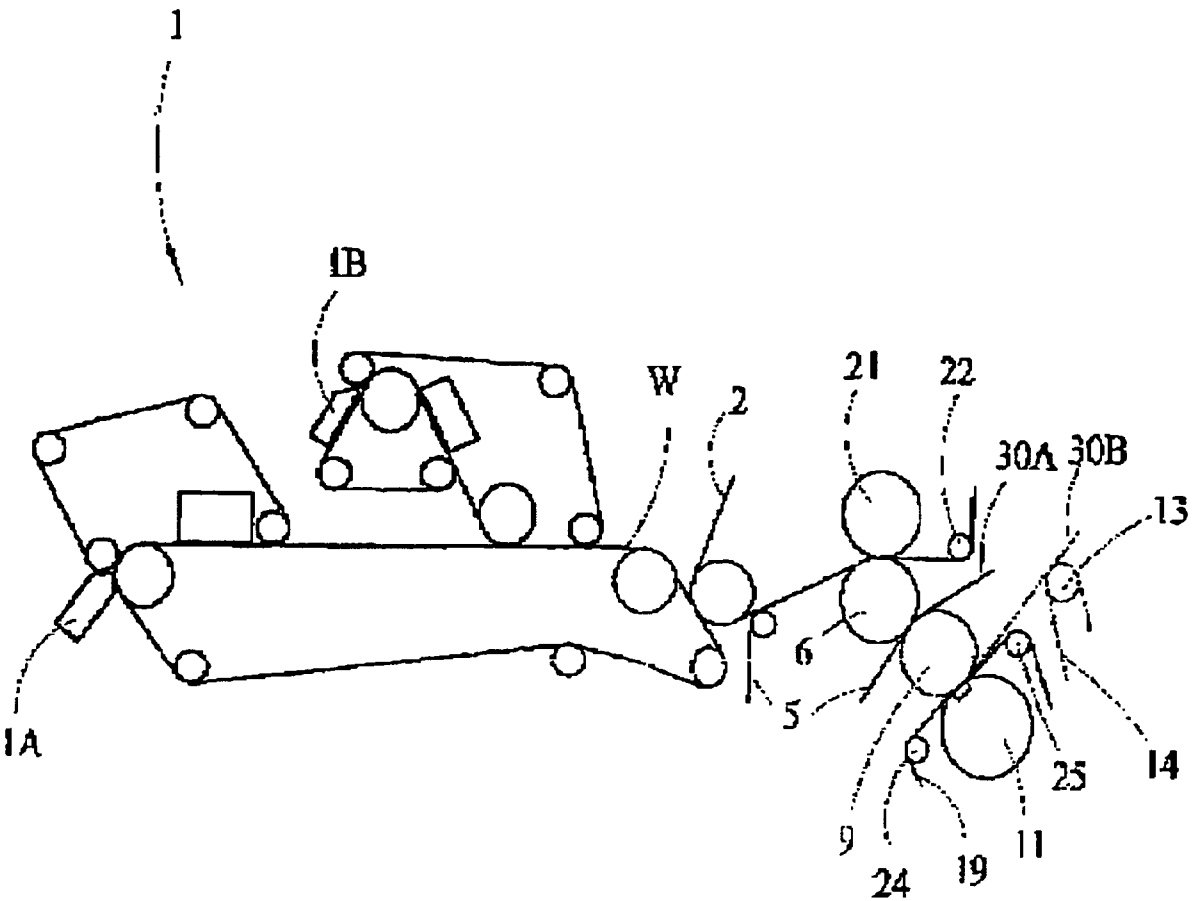

FIG. 3 is a schematic representation of a forming section and a press section according to another alternate embodiment of the invention.

Figure 4:
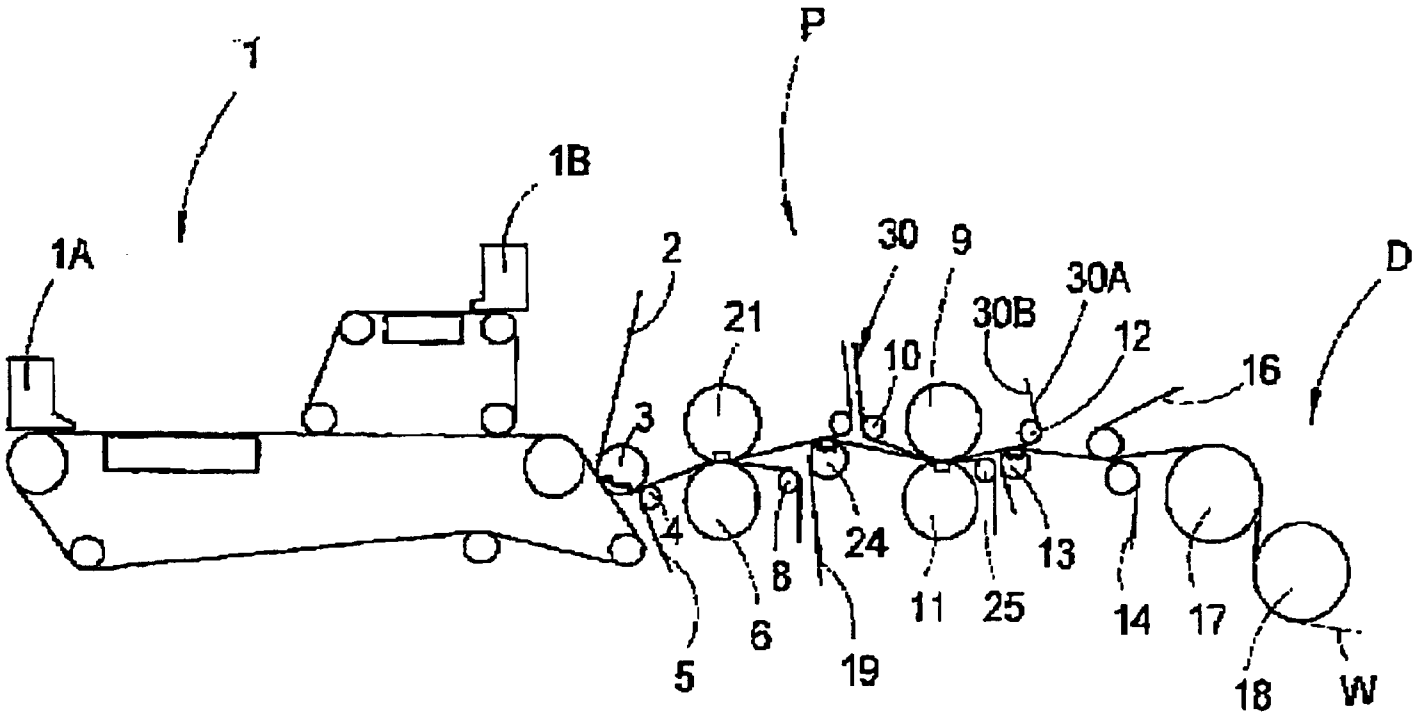
Figure 5:
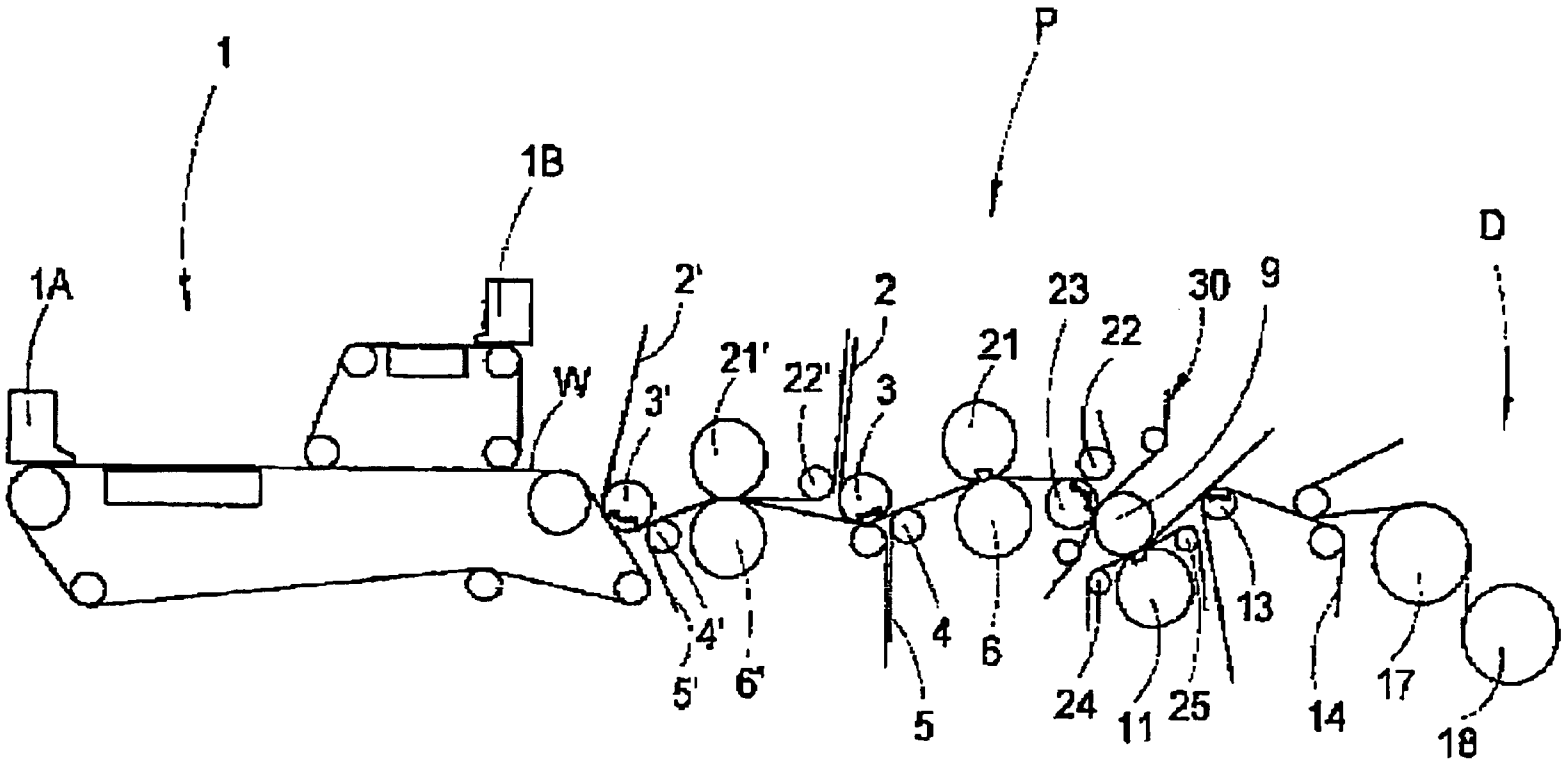
Figure 6:
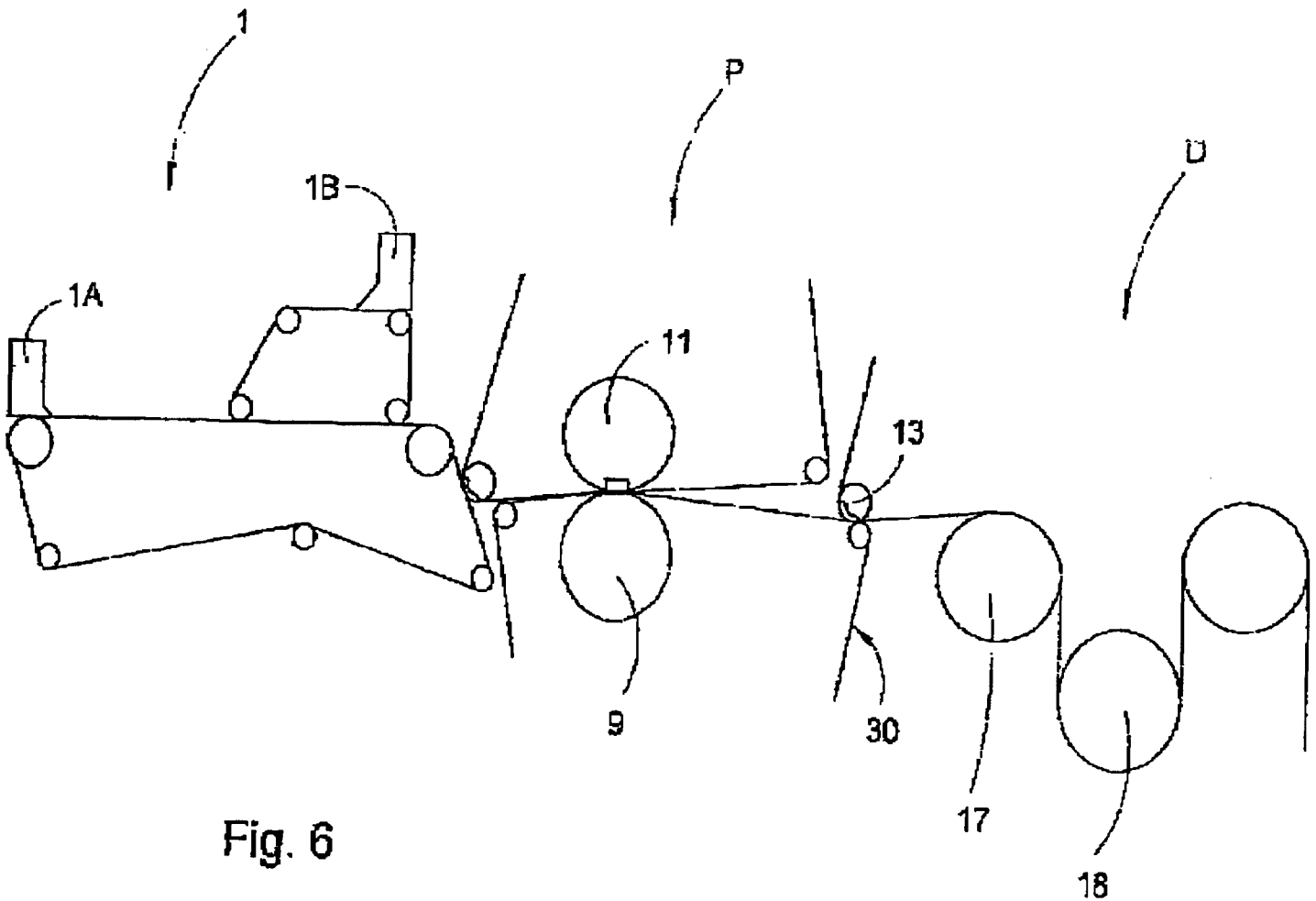

FIG. 4 is a schematic representation of a papermaking machine in accordance with another alternate embodiment of the invention, FIG. 5 is a schematic representation of a papermaking machine in accordance with another alternate embodiment of the invention, and FIG. 6 is a schematic representation of a papermaking machine in accordance with another alternate embodiment of the invention.

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

FIG. 1 shows one embodiment in accordance with the invention. A forming section 1 is illustrated. The forming section 1 consists of a fourdrinier wire, with two forming units comprising a first 1A and a second 1B headbox. The construction shown is known to one skilled in the art and is therefore not described in detail. By the forming section 1, a fiber web W is created, which consists of a base layer and a top layer. After the forming section 1, the fiber web W is conveyed into a press section P, by being transferred onto a first press felt 2 with a pick-up suction roll 3. The press section comprises three roll nips, which are formed by only four rolls 6, 7, 9, 11, whereby a compact arrangement can be achieved. To be able to optimize the overall height of the section, the rolls are suitably placed, somewhat laterally in relation to each other, so as to be placed in the proximity to an oblique (non-vertical) line. (see also FIG. 3) The press felt 2 runs from the pick-up suction roll 3 to a press roll 7 (suitably a suction roll) and then around guide rolls (not shown). The suction roll 7 constitutes the upper roll in a first nip which is achieved between the suction roll 7 and a second press roll 6 placed towards the bottom. The press roll 6 cooperates with a lower press felt 5, which cooperates with two guide rolls, 4, 8. Consequently, a double-felted nip is created between the first two press rolls 6, 7. A second nip is created between the first suction roll 7 and a third press roll 9. The second nip is also double-felted, in that a third press felt 19 runs around the third press roll 9.

Finally, a third roll nip is shown, between the third press roll 9 and a shoe press roll 11. Apart from the third felt 19, one impermeable transfer belt 30 is fed through the third nip. The transfer belt 30 has at least one smooth surface 30A, which is configured to turn away from the shoe press unit 11 and against the third press felt 19. The transfer belt 30 passes a first guide roll 10 before the nip and around a second guide roll 12 after the nip. Immediately before (seen in the machine direction) the second guide roll 12, a fourth felt 14 (or drying wire), which runs around a suction roll 13 and a guide roll 15, abuts the bottom side of 30A of the transfer belt 30. Thereafter, a drying section D follows, which is only partially shown. A drying wire 16, a vacuum roll 17 and a drying cylinder 18 are also shown. The vacuum roll 17 is arranged so that the drying wire 16 runs against the felt 14 between the suction roll 13 and the guide roll 15.

The above-described device is, in accordance with embodiments of the invention, intended to manufacture, with high efficiency, a multilayer liner having a top layer with high printability. The described device operates in the following manner. Abase layer is applied on the fourdrinier wire by a first headbox 1A. Thereafter, a top layer is spread (in a known manner) by a second headbox 1B. The base layer consists essentially of pulp containing long fibers, preferably containing fir and/or pine fibers. The top layer is suitably formed by a pulp, which at least partially contains short fibers. (It will be understood that the determinations regarding the weight-% of fibers, which are mentioned, relates to the end product.) In most applications, fibers from easily bleached kinds of wood, such as birch or eucalyptus, are preferably used for the top layer, which are bleached to a relatively high brightness, preferably over 85 ISO, more preferably to a brightness exceeding 90 ISO. The formed fiber web W is then fed over to the press section P with a pick-up suction roll 3 and the felt 2 that runs therearound. Consequently, the top layer abuts against the felt 2. The base layer then meets the lower press felt 5 and the fiber web w is fed through the first roll nip 6, 7 which is accordingly double-felted. The fiber web then follows the felt 2 around the first suction roll 7 into the second roll nip 7, 9. In the second roll nip, the top layer abuts against the press felt 2, while the base layer abuts against a third smoother press felt 19. The web thereafter follows the smoother third press felt 19, around a third press roll 9, which preferably consists of a grooved roll. The web then runs into the third roll nip 9, 11 in which the top layer meets the smooth surface 30A of the impermeable transfer belt 30. The web follows the impermeable transfer belt 30 until it encounters the drying wire/felt 14 which runs around the suction roll 13. The web then follows the felt 14 until it encounters the drying wire 16 and the web thereafter follows the drying wire 16 around the vacuum roll 17 to a drying cylinder 18 and further into the drying section D.

In FIG. 2, an alternate embodiment of the invention is shown. This embodiment is similar to the embodiment shown in FIG. 1, and therefore just the variations will be described. According to this embodiment, five rolls are used to create the three nips, instead of four rolls as shown in FIG. 1, which allows larger flexibility for the set of rolls. As shown, the first roll nip is created with a shoe press roll 21 which presses against a lower press roll 6. A suction press roll 23 follows thereafter, which constitutes the second nip with the next-to-last press roll 9. A guide roll 22 is arranged above the press roll 23 in order to convey the felt 2. The lower press felt 5 runs, as previously described, through the first roll nip and around the press roll 23. In this embodiment, the transfer belt 30 runs around the next-to-last press roll 9. As in FIG. 1, the last press unit 11 is formed with a shoe press roll. A press felt 19 runs around the shoe press roll 11 as guided by guide rolls 24, 25. In accordance with FIG. 1, the top layer abuts the upper press felt 2 in the first nip 6, 21, and is thereafter separated from the press felt 2 with the suction roll 23. The web may also be separated from the upper press felt 2 directly after the first nip since the guide roll 22 is preferably movably arranged, whereby the web W may be allowed to run towards the second nip in contact only with the lower press felt 5. In the second nip 23, 9, the top layer encounters the smooth surface 30A of the transfer belt 30 and thereafter follows the transfer belt 30 around the next-to-last press roll 9 and through the last nip 9, 11. Thereafter, as in FIG. 1, the web is transferred to a drying wire/felt 14 which runs toward the drying section D. Consequently, the top layer is also pressed in the last nip against the smooth surface 30A of the transfer belt.

In FIG. 3, a further embodiment in accordance with the invention is shown. In contrast to the embodiments shown in FIGS. 1 and 2, a twin wire former with a first 1A and a second 1B headbox is used for creating a web W with a top layer and a base layer. In accordance with FIG. 1, the press section is formed of only four press rolls. The first roll nip consists of a first press roll 21 and a suction roll 6. In accordance with FIG. 2, the transfer belt 30 runs around the next-to-last press roll 9 in order to form both the next-to-last nip 6, 9 and the last nip 9, 11. In addition, the last press unit comprises a shoe press roll 11. Also, as in FIG. 1 and FIG. 2, the web is transferred from the transfer belt 30 to a drying wire/felt 14 as shown in FIG. 3, over a suction roll 13, and then to a drying wire (not shown).

In FIG. 4, still another embodiment in accordance with the invention is shown wherein only two roll nips are used. The forming section 1 is similar to that shown in FIGS. 1 and 2. Also, the transferring of the web from forming section 1 to drying section D is substantially similar to that previously described herein. The first nip 6, 21 is substantially similar to the configuration shown in FIG. 2, except that the lower press felt 5 in FIG. 4 runs only through one roll nip and the upper press felt 2 preferably consists of a smooth felt. The first nip 6, 21 can, however, also comprise a press. In the last roll nip 9, 11, in a similar manner to the earlier shown embodiments, the top layer of the web encounters the smooth surface 30A of the transfer belt 30. The web W is then transferred in a known manner with a suction roll 24 from the upper felt 2 to the third press felt 19, before being conveyed into the last nip 9, 11.

In FIG. 5 there is shown a further embodiment according to the invention. In FIG. 5, the main portion of the press section P is similar to the press section shown in FIG. 2. The transfer zone from the press section to the drying section D of FIG. 5 is similar to that shown in FIG. 4. The variation of the embodiment shown in FIG. 5 comprises the arrangement of another press roll nip 6', 21' at the beginning of the press section P. As shown, the fiber web W is transferred from the forming section 1 to the press section P by a press felt 2' and a suction pick up roll 3', which conveys the web on to the press felt 2'. Thereafter, the web W encounters a second press felt 5' from below, such that a double-felted nip is created between the first pairs of rolls 6', 21' forming the first roll nip. As shown in FIG. 5, the first nip is a press roll nip without a shoe press roll. The web W then follows the lower press felt 5' into contact with a suction roll 3, which transfers the web W onto a third press felt 2. Thereafter, the press section is similar to that shown in FIG. 2 and, accordingly, is not described in detail. However, it should also be noted that this press section, including four roll nips, is configured such that the top layer of the web is pressed against the smooth surface 30A of the transfer belt in the last nip.

The invention is not limited to what is described herein, but can be varied within the scope of the following claims. Consequently, it will be understood that, for instance, more than four roll nips can be used, if desired for certain installations. In addition, it will be understood that more arrangements of rolls may be used in accordance with the invention. Further, it will be understood that a liner consisting of more than two layers can be produced by a method according to the invention, for instance triple layers, four layers, etc. wherein different mixtures of pulp can be used to manufacture desired products. It will also be understood that, in certain cases, mixtures of pulp entirely without short fibers may be preferred for the top layer. Furthermore, the top layer may be formed, so as to constitute the lower layer in the fiber web, by initially applying the top layer with the first headbox IA on the forming wire, wherein the equipment in the press section must be reversed, at least with reference to the last roll nip as shown in FIG. 6. Finally, it will be understood that the web W may be configured to run vertically through the last nip.

Moreover, it is known to one skilled in the art that the transfer belt does not have to be impermeable, even though this is normally preferred. One skilled in the art also knows that there exist several different options of impermeable transfer belts that can be used, such as, for example, a TRANSBELT™ (trademark belonging to Albany International).

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A method of producing a liner, said method comprising:

forming a fiber web in a forming section having at least two forming units, the fiber web comprising at least a top layer and a base layer; and conveying the fiber web from the forming section through a press section and to a drying section, the press section comprising at least one double-felted press nip preceding a last nip, the last nip having a transfer belt with a smooth surface pussing therethrough, the transfer belt being configured to be conveyed through the last nip with the top layer of the fiber web engaging the smooth surface.

2. A method according to claim 1 wherein conveying the fiber web through a press section further comprises conveying the fiber web through a press section having the last nip configured to exert a linear load of between about 600 kN/m and about 2000 kN/m on the fiber web.

3. A method according to claim 1 wherein the press section comprises at least three nips arranged in the machine direction such that the last nip immediately precedes the drying section and conveying the fiber web through a press section further comprises conveying the fiber web through a next-to-last nip, immediately preceding the last nip, configured to exert a linear load of between about 30 kN/m and about 150 kN/m on the fiber web.

4. A method according to claim 3 wherein conveying the fiber web through a press section further comprises conveying the fiber web through a leading nip, immediately preceding the next-to-last nip, comprising a shoe press configured to exert a linear load of between about 200 kN/m and about 1000 kN/m on the fiber web.

5. A method according to claim 3 wherein conveying the fiber web through a press section further comprises conveying the fiber web through a leading nip, immediately preceding the next-to-last nip, comprising a press configured to exert a linear load of between about 50 kN/m and about 200 kN/m on the fiber web.

6. A method according to claim 1 wherein conveying the fiber web through a press section further comprises conveying the fiber web through a press section at a rate of between about 750 m/min and about 2000 m/min.

7. A method according to claim 6 wherein conveying the fiber web through a press section further comprises conveying the fiber web through a press section at a rate of between about 1000 m/min and about 2000 m/min.

8. A method according to claim 7 wherein conveying the fiber web through a press section further comprises conveying the fiber web through a press section at a rate of between about 1200 m/min and about 2000 m/min.

9. A method according to claim 1 further comprising conveying the fiber web through the drying section, the drying section being configured to produce a liner having a grammage of between about 60 $g/m^2$ and about 205 $g/m^2$.

10. A method according to claim 9 further comprising conveying the fiber web through the drying section, the drying section being configured to produce a liner having a grammage of between about 60 $g/m^2$ and about 150 $g/m^2$.

11. A method according to claim 1 wherein forming a fiber web further comprises forming the base layer of unbleached and substantially long-fibered pulp comprising at least one of fir tree fiber and pine tree fiber.

12. A method according to claim 1 wherein forming a fiber web further comprises forming the top layer of bleached and at least partially short-fibered pulp comprising at least one of birch tree fiber and eucalyptus tree fiber.

13. A method according to claim 1 wherein forming a fiber web further comprises forming a fiber web having the top layer comprising bleached pulp.

14. A method according to claim 1 wherein forming a fiber web further comprises forming a fiber web having the top layer comprising at least 30 weight-% of short fiber.

15. A method according to claim 1 wherein forming a fiber web further comprises forming a fiber web having the top layer comprising at least 50 weight-% of short fiber.

16. A method according to claim 1 wherein forming a fiber web further comprises forming a fiber web comprising the top layer adjacent to the base layer.

17. A method according to clam 1 wherein conveying the fiber web further comprises conveying the fiber web through the last nip with the top layer of the fiber web engaging the smooth surface of an impermeable transfer belt.

18. A method of producing a liner, said method comprising:

forming a fiber web in a forming section hiving at least two forming units, the fiber web comprising at least top bleached pulp layer and a base unbleached pulp layer; and conveying the fiber web from the forming section tough a press section mid to a drying section, the press section comprising at least one double-felted press nip preceding a last nip, the last nip having a transfer belt with a smooth surface passing therethrough, the transfer belt being configured to be conveyed through the last nip with the top bleached pulp layer of the fiber web engaging the smooth surface.

19. A method according to claim 18 wherein conveying the fiber web further comprises conveying the fiber web through the last nip with the bleached pulp layer of the fiber web engaging the smooth surface of an impermeable transfer belt.

20. A method of producing a liner, said method comprising:

forming a fiber web in a forming section having at least two forming units, the fiber web comprising at least a top bleached pulp layer having at least 30 weight-% of short fiber and a base unbleached layer having substantially all long fiber; and conveying the fiber web from the forming section through a press section and to a drying section, the press section comprising at least one double-felted press nip preceding a last nip, the last nip having a transfer bell with a smooth surface.

21. A method according to claim 20 wherein conveying the fiber web further comprising conveying the fiber web through the last nip with the bleached pulp layer of the fiber web engaging the smooth surface of an impermeable transfer belt.

22. A papermaking device for producing a liner, said device comprising:

a forming section having at least two forming units for forming a fiber web having at least a top layer and a base layer; and a press section for receiving the fiber web from the forming section and conveying the fiber web to a drying section, the press section comprising:

at least one double-felted press nip preceding a last nip; and a transfer belt having a smooth surface, the transfer belt being configured to be conveyed through the last nip with the top layer of the fiber web engaging the smooth surface.

23. A papermaking device according to claim 22 wherein the last nip comprises a shoe press having a shoe press roll disposed adjacent to a press roll and the transfer belt is configured to pass about (he press roll such that the smooth surface is directed away therefrom.

24. A papermaking device according to claim 22 wherein the press section further comprises at least three nips arranged in the machine direction such that the last nip immediately precedes the drying section and a next-to-last nip, immediately preceding the last nip, comprises a press.

25. A papermaking device according to claim 22 wherein the press section further comprises four rolls disposed adjacently so as to form three nips.

26. A papermaking device according to claim 22 wherein the press section further comprises five rolls disposed adjacently so as to form three nips arranged in the machine direction such that a leading nip precedes a next-to-last nip which, in turn, precedes the last nip immediately preceding the drying section and the leading nip further comprises a shoe press.

27. A papermaking device according to claim 22 wherein the transfer belt is configured to be impermeable.

* * * * *